US009211021B2

(12) United States Patent
Smith

(10) Patent No.: US 9,211,021 B2
(45) Date of Patent: Dec. 15, 2015

(54) DISPLAY HUTCH

(71) Applicant: Sonoco Development, Inc., Hartsville, SC (US)

(72) Inventor: Andre C. Smith, Westmont, IL (US)

(73) Assignee: Sonoco Development, Inc., Hartsville, SC (US)

( * ) Notice: Subject to any disclaimer, the term of this patent is extended or adjusted under 35 U.S.C. 154(b) by 157 days.

(21) Appl. No.: 14/024,137

(22) Filed: Sep. 11, 2013

(65) Prior Publication Data

US 2015/0068998 A1 Mar. 12, 2015

(51) Int. Cl.
*A47F 5/00* (2006.01)
*A47F 5/11* (2006.01)

(52) U.S. Cl.
CPC ..... *A47F 5/116* (2013.01)

(58) Field of Classification Search
CPC ..... A47F 5/116; A47F 5/114; A47F 5/112; A47F 5/00; A47B 43/02; A47B 43/00; A47B 47/06
USPC ..... 248/174; 211/135, 149, 59.2, 53, 72
See application file for complete search history.

(56) References Cited

U.S. PATENT DOCUMENTS

| | | | | | |
|---|---|---|---|---|---|
| 1,491,091 | A * | 4/1924 | Flynn | 211/135 |
| 2,307,992 | A * | 1/1943 | Calhoun et al. | 206/733 |
| 2,571,301 | A * | 10/1951 | Slanhoff | 211/135 |
| 3,362,610 | A * | 1/1968 | Van Dyke | 229/120.33 |
| 3,687,091 | A * | 8/1972 | Boylan | 108/60 |
| 4,080,907 | A * | 3/1978 | Kaufman | 108/59 |
| 4,151,803 | A | 5/1979 | Ferrera et al. | |
| 4,271,766 | A * | 6/1981 | Schmiedeler | 108/179 |
| 4,519,319 | A * | 5/1985 | Howlett | 108/180 |
| 5,145,244 | A * | 9/1992 | Kersting et al. | 312/259 |
| 5,213,220 | A * | 5/1993 | McBride | 211/132.1 |
| 5,366,100 | A | 11/1994 | Maglione | |
| 5,669,683 | A * | 9/1997 | Moss et al. | 312/259 |
| 5,711,438 | A * | 1/1998 | Smith | 211/149 |
| 5,826,732 | A | 10/1998 | Ragsdale | |
| D425,332 | S * | 5/2000 | Buchanan et al. | D6/675.3 |
| 6,105,796 | A * | 8/2000 | Buchanan et al. | 211/128.1 |
| 6,715,623 | B2 * | 4/2004 | Broerman | 211/149 |
| 6,752,280 | B2 * | 6/2004 | Dye | 211/149 |
| 7,007,615 | B2 * | 3/2006 | Grueneberg | 108/165 |
| 7,252,200 | B1 * | 8/2007 | Hester | 211/72 |
| 7,374,047 | B2 * | 5/2008 | Bryson et al. | 206/743 |
| 7,677,433 | B2 | 3/2010 | Little | |
| 7,753,218 | B2 * | 7/2010 | Moss et al. | 211/133.3 |
| D674,624 | S * | 1/2013 | Kassab et al. | D6/683.1 |
| 8,863,417 | B2 * | 10/2014 | Gerstner | 40/539 |
| 8,944,260 | B2 * | 2/2015 | Hawkins | 211/72 |
| 2004/0148825 | A1 * | 8/2004 | Myers et al. | 40/124 |
| 2011/0049072 | A1 | 3/2011 | Dewhurst | |
| 2013/0213915 | A1 * | 8/2013 | Pfeifer et al. | 211/135 |

* cited by examiner

*Primary Examiner* — Joshua Rodden
*Assistant Examiner* — Kimberly S Wright
(74) *Attorney, Agent, or Firm* — Miller, Matthias & Hull LLP

(57) ABSTRACT

A collapsible, easy-to-assemble corrugated hutch for shipping and displaying products is provided. The hutch comprises a back wall, two side walls, shelves and two side wall supports. The side walls are hingedly attached to the back wall and can be folded to capture the side wall supports. The shelves extend between the side walls and have front edges that are supported by the side walls and side wall supports.

16 Claims, 6 Drawing Sheets

DISPLAY HUTCH

BACKGROUND OF THE INVENTION

1. Field of the Invention

This invention patent relates to a display hutch. More particularly, this invention relates to a corrugated display hutch that is collapsible and does not require plastic clips, metal poles or similar components to support the shelves.

2. Description of the Related Art

Corrugated hutches, or hutch-like containers made primarily of corrugated board, can be used to ship and display items in a retail setting. The construction of such hutches can depend in large part on the amount of weight each shelf is expected to bear. Shelves in some existing corrugated hutches are supported by a combination of corrugated board, plastic interlocking clips, metal poles or similar components. For example, in one known version, the back of the shelf is anchored to the back wall of the hutch and the front of the shelf is supported by plastic interlocking clips that are inserted into the front lip of the shelf and attach to the side walls of the hutch. In another known version a metal pole locks into the side walls and supports the shelves from underneath.

A need exists for an inexpensive, easy-to-assemble corrugated hutch that does not require plastic clips, metal poles or similar components for supporting the shelves. The present invention is intended to fulfill this need while providing a collapsible, easy-to-assemble corrugated hutch for shipping and displaying products.

BRIEF SUMMARY OF THE INVENTION

The present invention is a collapsible corrugated hutch that does not require plastic clips, metal poles or similar components to support the front of the shelves. Instead, reinforced side walls support the front of the shelves.

In one aspect of the invention a hutch is provided, the hutch comprising a back wall, two side walls and at least one shelf. The back wall defines a number of elongated slots equal to the number of shelves.

Each shelf comprises a bottom panel and a cut out portion rotatably attached to the bottom panel about a rear fold line. The cut out portion is inserted through one of the elongated slots in the back wall. The bottom panel defines a slot on either side of the bottom panel.

The two side walls are hingedly attached to the back wall along rear fold lines. Each side wall comprises an outer panel and an inner panel connected by vertically oriented double fold lines. Each inner panel comprises at least one integrally formed first shelf support for supporting a shelf. Each first shelf support has a top edge and a locator tab extending upward from the top edge and configured to extend through one of the slots in the shelf.

The hutch may further comprise two side wall supports. Each side wall support may be captured ("sandwiched") between the outer panel and the inner panel of each side wall on either side of the hutch. Each side wall support may comprise at least one integrally formed second shelf support, so that the shelves are also supported by the second shelf supports.

Each shelf may further comprise a top panel attached to the bottom panel along double fold lines so that the top and bottom panels are in a flat, abutting relationship, thereby forming a shelf having two thicknesses of a material such as corrugated board. The top panel may define a slot on either side of the top panel and in vertical alignment with the slots defined by the bottom panel so that the locator tabs extend through the slots in both the bottom panel and the top panel.

The back wall and the two side walls may be formed from a first blank, and each shelf may be formed from a second blank. Each side wall support may be formed from a third blank. The blanks preferably are made of corrugated board.

In another aspect of the invention a hutch is provided comprising a back wall and two side walls formed from a first blank, and a plurality of shelves, each shelf made from one of a plurality of second blanks. The back wall defines vertically spaced apart, horizontal, elongated slots. The two side walls are foldably attached to the back wall.

Each side wall comprises an outer panel and an inner panel connected by vertically oriented double fold lines. The outer and inner panels are in spaced parallel relationship to each other and may accommodate a side wall support therebetween. Each inner panel comprises a plurality of vertically arranged shelf supports, with each shelf support having a horizontally oriented top edge and a locator tab extending upward from the top edge.

Each shelf comprises a top panel attached to a bottom panel along double fold lines. The top panel comprises a cut out portion foldably connected to the bottom panel along the double fold line. The top panel and the bottom panel each define slots located along laterally disposed sides of the shelf. The top panel is folded over onto the bottom panel so that the top panel lies flat against the bottom panel and the slots in the top panel align with the slots in the bottom panel. The cut out portion of each shelf is inserted into one of the elongated slots in the back wall so that the shelves are rotatably connected to the back wall portion.

The two side walls may be rotatable between a first "flat" position in which the two side walls are substantially coplanar with the back wall, and a second "display" position in which the side walls are perpendicular to the back wall and the shelf supports of one side wall are laterally spaced from the shelf supports of the other side wall.

Similarly, each shelf may be rotatable between a first "flat" position in which the shelf lies substantially flat against the back wall, and a second "display" position in which the shelf extends perpendicularly outward from the back wall and abuts (rests on) the top edges of laterally spaced shelf supports and the locator tabs of each pair of laterally spaced shelf supports extend through the slots in the shelf.

The hutch may further comprise two side wall supports, each made from one of two third blanks. Each side wall support may be captured between the outer panel and the inner panel of one of the side walls. Each side wall support may comprise a plurality of vertically arranged second shelf supports. Each of the second shelf supports of one of the side wall supports may be laterally spaced from a second shelf support of the other side wall support. Each second shelf support may have a horizontally oriented top edge, so that in the second "display" position each shelf also abuts and is supported by the top edges of a pair of laterally spaced apart second shelf supports.

Each side wall support may comprise two hingedly connected, similarly shaped halves which are folded together to form a side wall support having a double thickness. Thus each lateral side of each shelf may be supported by three thicknesses of material, one thickness being the top edge of a shelf support forming part of a side wall inner panel and the other two thicknesses being the two top edges of a second shelf support.

In another aspect of the invention a method of assembling a hutch is provided. The method may comprise the steps of:

providing a first blank including a back wall portion defining vertically spaced apart, horizontal, elongated slots and two side wall portions foldably attached to the back wall portion, each side wall portion comprising an outer panel and an inner panel connected by vertically oriented double fold lines, each inner panel comprising a plurality of vertically arranged shelf supports, each shelf support having a top edge and a locator tab extending upward from the top edge;

providing a plurality of second blanks, each second blank comprising a top panel portion attached to a bottom panel portion along double fold lines, the top panel portion comprising a cut out portion foldably connected to the bottom panel portion along the double fold line, the second blank defining slots located in the top panel and in the bottom panel;

folding the top panel of each second blank along the double fold lines until the top panel lies flat against the bottom panel and the slots in the top and bottom panels align to form a plurality of shelves; and inserting the cut out portion of each shelf into one of the elongated slots in the back wall so that the shelves are rotatably connected to the back wall.

The two side wall portions may be rotatable between a first "flat" position in which the two side wall portions are substantially co-planar with the back wall portion and a second "display" position in which the side wall portions are perpendicular to the back wall portion and the shelf supports of one side wall portion are laterally spaced from the shelf supports of the other side wall portion.

Similarly, each shelf may be rotatable between a first "flat" position in which the shelf lies substantially flat against the back wall portion and a second "display" position in which the shelf extends perpendicularly outward from the back wall portion and abuts the top edges of laterally spaced shelf supports and the locator tabs of the laterally spaced shelf supports extend through the slots in the shelf.

The method may comprise the further steps of:

providing a pair of third blanks, each third blank comprising two halves foldably connected to form a side wall support having a double thickness of material;

placing a side wall support against an inner facing surface of each side wall outer panel; and inwardly folding the side wall inner panels until they are substantially parallel to and spaced apart from the outer panels and the side wall supports are captured between the outer panels and the inner panels.

DETAILED DESCRIPTION OF THE INVENTION

Figure 1:
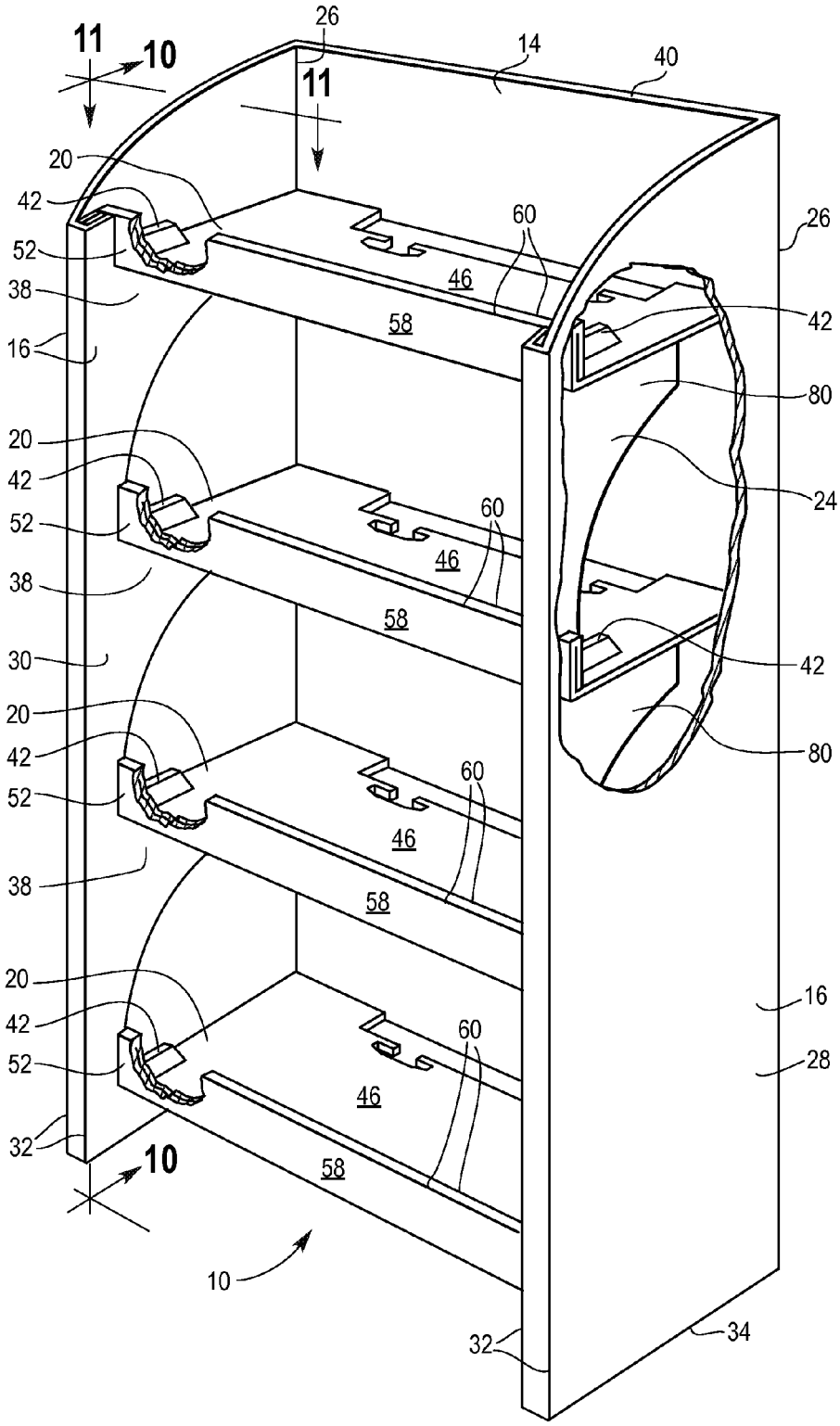
FIG. 1 is a front perspective view of a hutch according to the invention, shown in partial cutaway view.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

The invention is a collapsible corrugated hutch that does not require plastic clips, metal poles or similar components to support the front of the shelves. Instead, side walls reinforced with side wall supports support the front of the shelves.

Display Hutch

Figure 2:
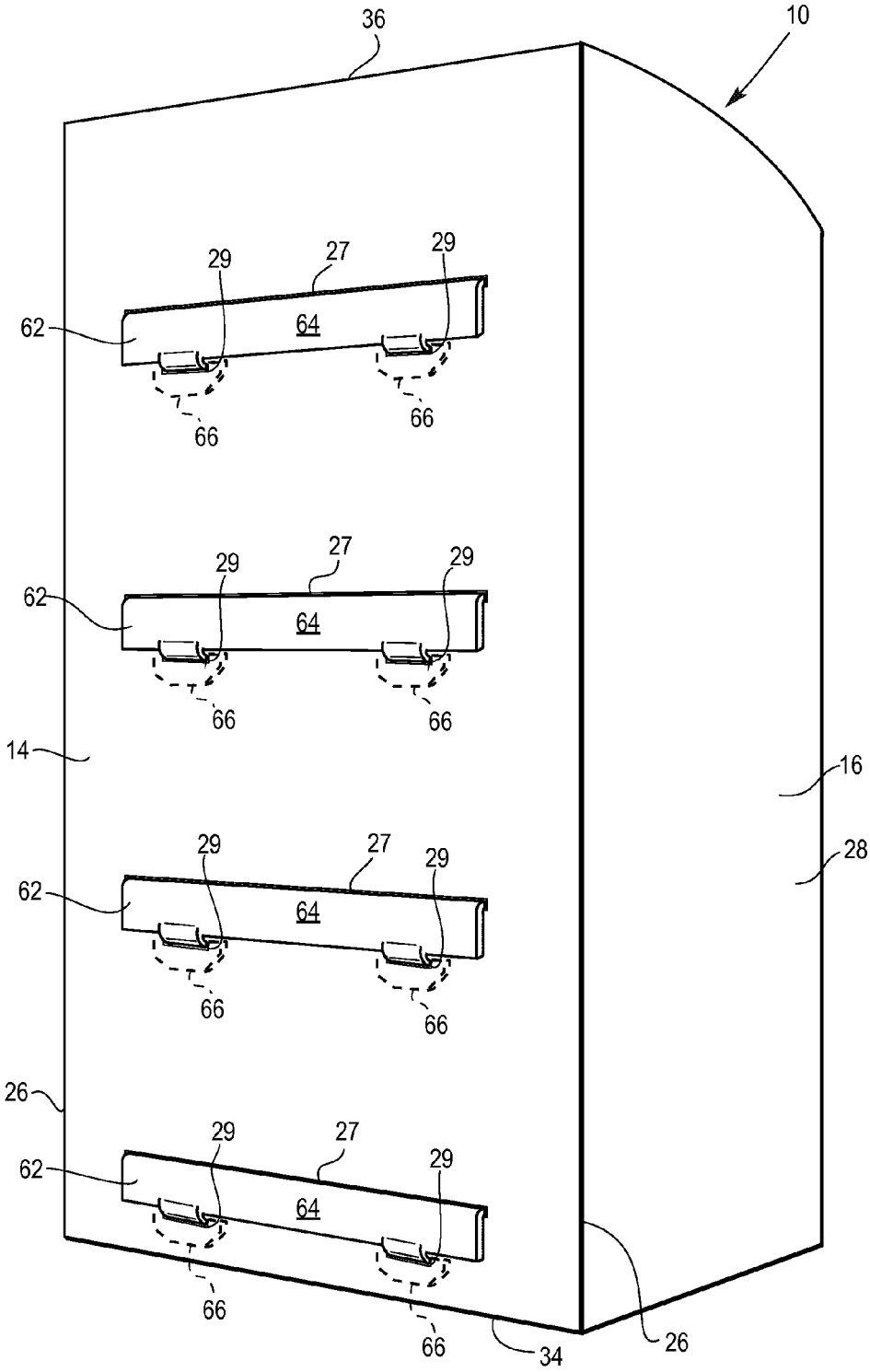
FIG. 2 is a back perspective view of the hutch of FIG. 1.

Turning to the drawings, there is shown in FIGS. 1 and 2 front and rear views of an embodiment of the present invention, a collapsible, easy-to-assemble, corrugated hutch 10 for shipping and displaying products. The hutch 10 comprises a back wall 14, two side walls 16, four shelves 20 and two side wall supports 24. The side walls 16 are hingedly attached to the back wall 14 along rear fold lines 26. The shelves 20 extend between the side walls 16 and are supported by the side walls 16 and side wall supports 24 as explained below. The shelves 20 preferably are double thickness, with a top panel 46 attached to a bottom panel 48 along double fold lines 50. Each shelf 20 further comprises a shallow front wall 52.

The hutch 10 shown in FIGS. 1 and 2 is made from seven separate components:

a first blank 12 (FIG. 3) for making the back wall 14 and side walls 16, four second blanks 18 (FIG. 4) for making each of the four shelves 20, and two third blanks 22 (FIG. 5) for making each of two side wall supports 24.

Figure 3:
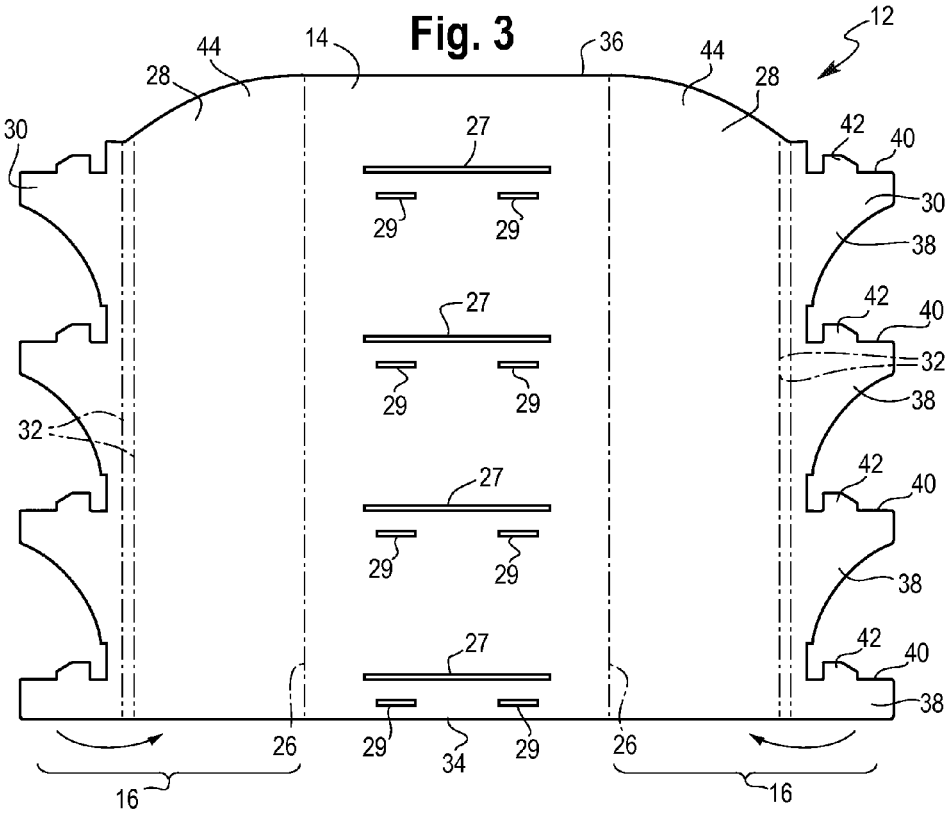
FIG. 3 is a top plan view of a first blank used to make the back wall and side walls of the hutch of FIG. 1.

FIG. 3 is a top plan view of the first blank 12, used to make the back wall 14 and side walls 16 of the hutch 10 of FIG. 1. The blank 12 includes the back wall portion 14 which may be substantially rectangular and extends vertically from a bottom edge 34 to a top edge 36 and horizontally from one fold line 26 to an opposing fold line 26. The back wall portion 14 defines vertically spaced apart, horizontal, elongated slots 27 for receiving a cut out portion 62 of each shelf 20, and a pair of narrow slots 29 located below each elongated slot 27 for receiving two tabs 66 that extend from the body 64 of each cut out portion 62 to further secure the shelves 20.

Each side wall portion 16 of the first blank 12 comprises an outer panel 28 and an inner panel 30 connected by vertically oriented double fold lines 32. Each outer panel 28 extends vertically from a bottom edge 34 to a top edge 36 and horizontally from the rear fold line 26 to one of the double fold lines 32. Each inner panel 30 comprises a plurality of irregularly shaped, vertically arranged shelf supports 38. Each first shelf support 38 has a top edge 40 for supporting one lateral side of a shelf 20 and a locator tab 42 that extends upward from the top edge 40. Each locator tab 42 fits through a corresponding slot 68 in one of the shelves 20.

Figure 4:
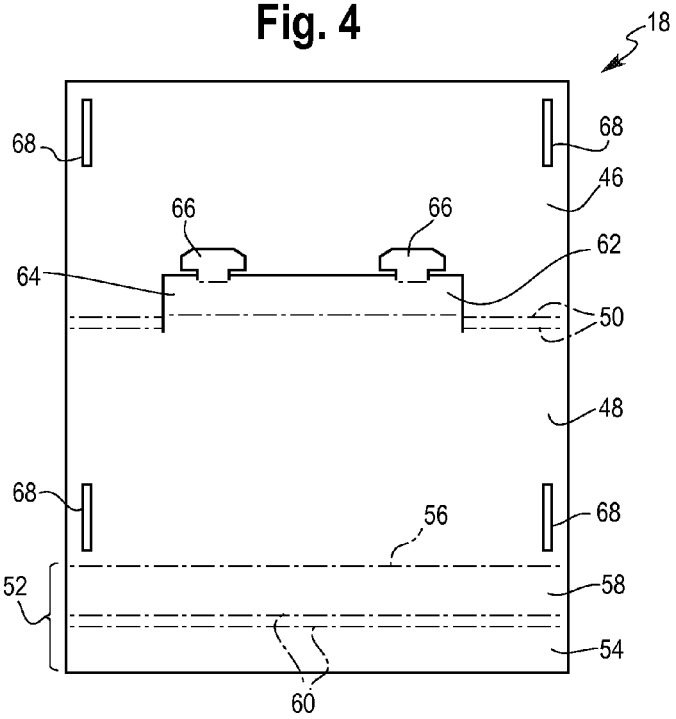
FIG. 4 is a top plan view of a second blank used to make the shelves of the hutch of FIG. 1.

FIG. 4 is a top plan view of a second blank 18 used to make the shelves 20 of the hutch 10 of FIG. 1. The second blank 18 has a top panel portion 46 attached to a bottom panel portion 48 along double fold lines 50 and a shallow front wall portion 52 foldably connected to the bottom panel 48 along a fold line 56. The front wall portion 52 comprises an inner front panel 54 foldably connected to the bottom panel 48 along the fold line 56 and an outer front panel 58 foldably connected to the inner front panel 54 along double fold lines 60.

To assemble a shelf 20, the top panel 46 may be rotated along the double fold lines 50 until it lies flat against the bottom panel 48. The inner front panel 54 is folded over along the double fold lines 60 until it lies flat against the outer front panel 58 and then the inner and outer front panel assembly (a.k.a. front wall 52) is folded along fold line 56 until the front wall 52 is perpendicular to the top and bottom panels 46, 48.

The top panel 46 comprises a cut out portion 62 that can be lifted and rotated about the rear double fold line 50. The cut out portion 62 comprises an elongated body 64 hingedly attached to the bottom panel 48 and tabs 66 extending from the body 64. The second blank 18 further comprises slots 68 located along the lateral sides of the top panel 46 and the bottom panel 48 parallel to the side edges of the top and bottom panels 46, 48. The slots 68 in the top and bottom panels 46, 48 align when the top panel 46 is folded over onto the bottom panel 48.

Figure 5:
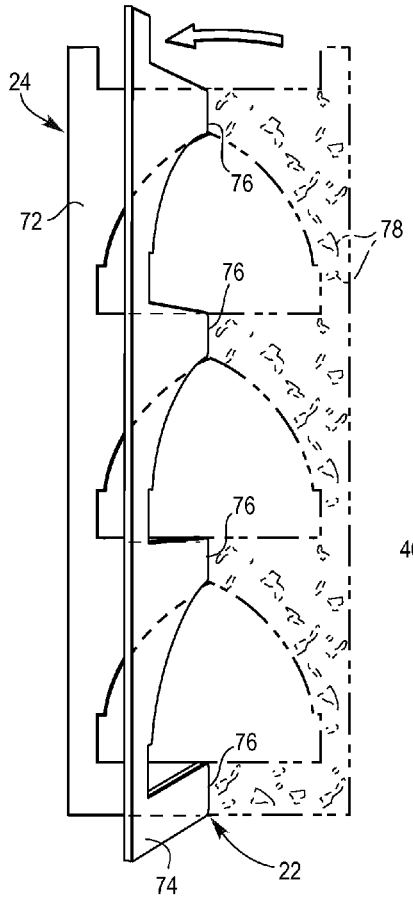
FIG. 5 is a perspective view of a partially assembled side wall support formed from a third blank and used in the hutch of FIG. 1.

FIG. 5 is a perspective view of a third blank 22 used to form each of the two side wall supports 24 used as components of the hutch 10 of FIG. 1. The third blank 22 comprises two halves 72, 74 connected by a score line 76. Glue or other fastening means 78 may be applied to a surface of one half 74, and then the half 74 may be folded along the score line 76 until it mates with the other half 72 to form a side wall support 24 having a double thickness of corrugated board. The hutch 10 preferably comprises a pair of these side wall supports 24, with a side wall support 24 captured between the outer panel 28 and the inner panel 30 of each side wall 16 as perhaps best shown in FIG. 1.

Method of Assembling the Hutch

The hutch 10 of FIGS. 1 and 2 may be assembled from the seven blanks shown in FIGS. 3, 4 and 5 as follows. Four second blanks 18 (FIG. 4) are folded to make four shelves 22. Each shelf 22 is then attached to the back wall 14 of the first blank 12 (FIG. 3).

FIG. 2 is a back perspective view of the hutch 10 of FIG. 1. To attach a shelf 20 to the back wall 14, the cut out portion 62 is inserted through an elongated slot 27 in the back wall 14 and folded downward. The tabs 66 are then inserted through the narrow slots 29 in the back wall 14. In this way the shelves 20 are rotatably connected to the back wall 14 can be folded substantially flat against the back wall 14 during transport.

Side wall supports 24 are formed from the third blanks 22 and then attached to the inner facing surfaces 44 of the side wall outer panels 28. Finally, the side wall inner panels 30 are folded over the side wall supports 24 as shown in FIG. 6 to capture the side wall supports between the outer panels 28 and the inner panels 30.

Figure 6:
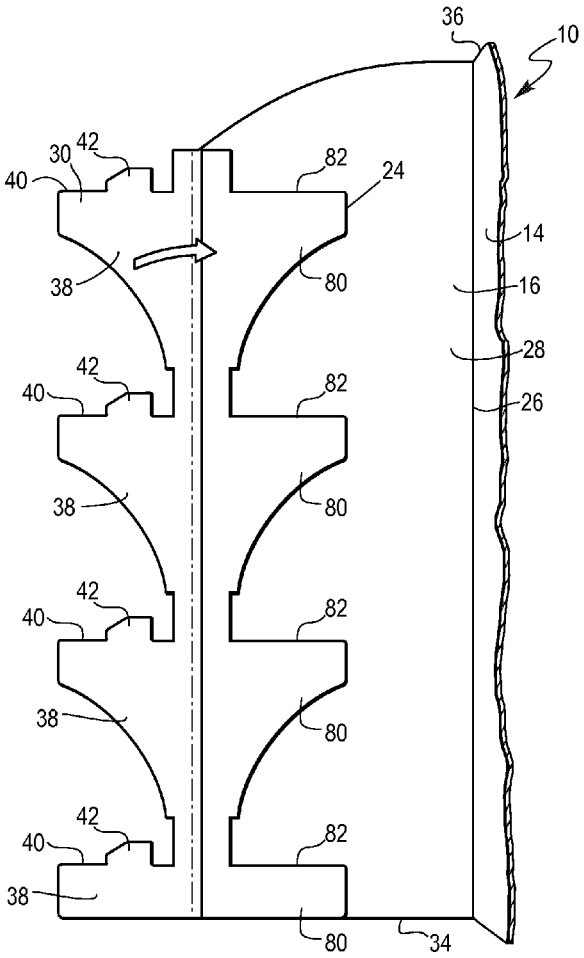
FIG. 6 is a perspective view showing a side wall support being captured within a side wall.

FIG. 6 is a perspective view of a partially assembled hutch 10 showing a side wall support 24 before the side wall inner panel 30 is folded over to capture the side wall support 24. Each folded side wall support 24 is shaped almost like a side wall inner panel 30, and comprises a series of vertically arranged shelf supports 80. Each second shelf support 80 has a top edge 82 that abuts the underside of a shelf 20 to help support the shelf 20.

Figure 7:
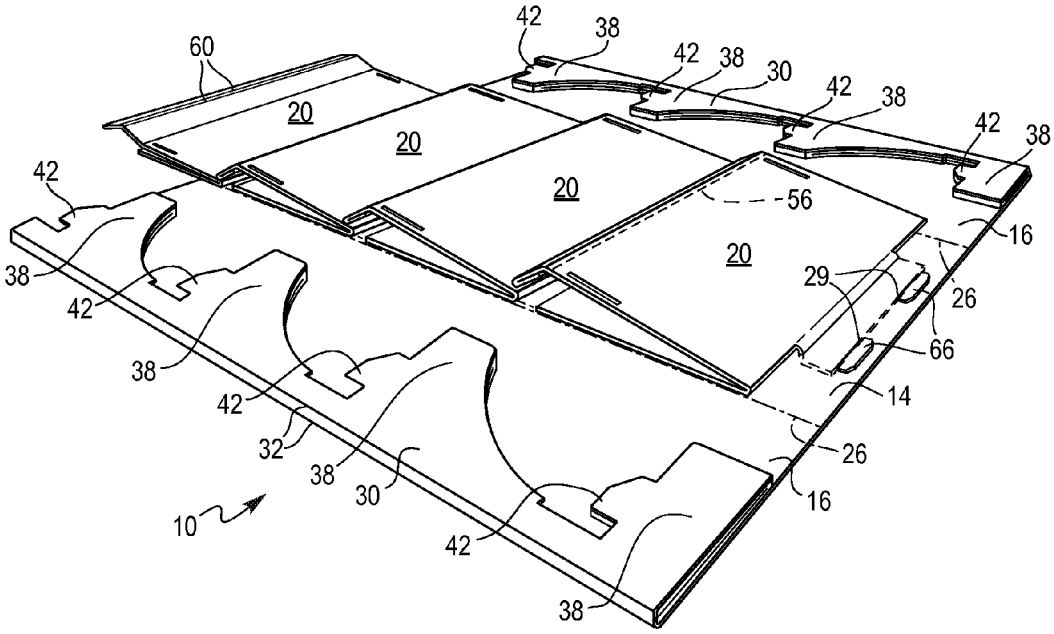
FIG. 7 is a perspective view of the hutch of FIG. 1 shown in its "flat" condition prior to being erected.

FIG. 7 is a perspective view of an assembled hutch 10 in its folded condition as it might be encountered on-site, prior to being unfolded (erected) and stocked with products. The hutch 10 can be shipped in this "flat" condition. The shelves 20 are attached to and lie almost flat against the rear panel 14. The side wall supports 24 are captured within the side walls 16 to create reinforced side walls 16.

Method of Erecting the Hutch

Figure 8:
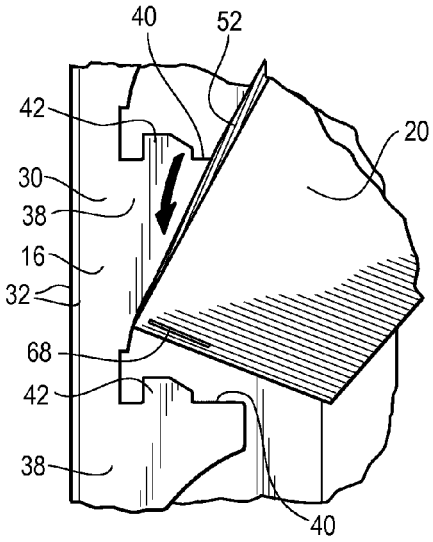
FIG. 8 is a perspective view showing a shelf being rotated into position.
Figure 9:
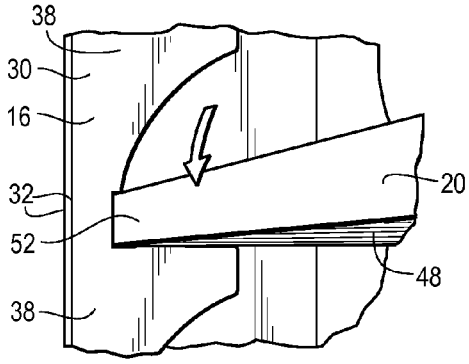
FIG. 9 is a perspective view showing a shelf rotated into its final "display" position.

To erect the folded hutch 10 of FIG. 7, the reinforced side walls 16 are folded inwardly along the rear fold lines 26 until they are perpendicular to the back wall 14. Next, as shown in FIGS. 8 and 9, the shelves 20 are rotated downward until the side wall tabs 42 extend through the shelf locator slots 68 and the shelves 42 rest on and are supported by the side wall inner panels 30 and side wall supports 24. The finished hutch 10, shown in FIGS. 1 and 2, may be placed in a bottom tray (not shown).

Figure 10:
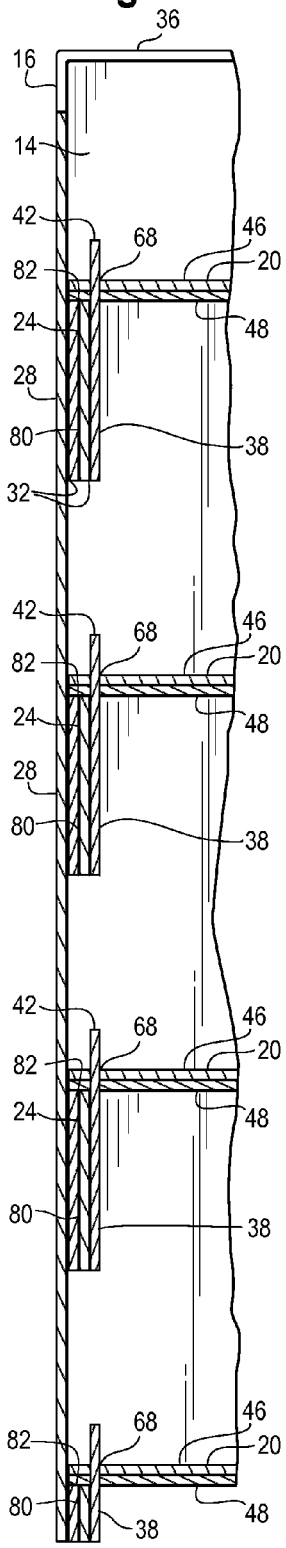
FIG. 10 is a cross-sectional view of the hutch of FIG. 1 taken along line 10-10.

FIG. 10 is a cross-sectional view of the hutch 10 of FIG. 1 taken along line 10-10. Each lateral side of each shelf 20 rests on three layers of material: one layer is provided by the inner panel 30 of the side wall 16 and two layers are provided by the folded side wall supports 24. More specifically, each lateral side of each shelf 20 is supported by three thicknesses of corrugated board, one thickness being the top edge 40 of a shelf support 38 forming part of a side wall inner panel 30 (see, e.g. FIG. 8), and the other two thicknesses being the top edge 82 of a folded second shelf support 80.

Figure 11:
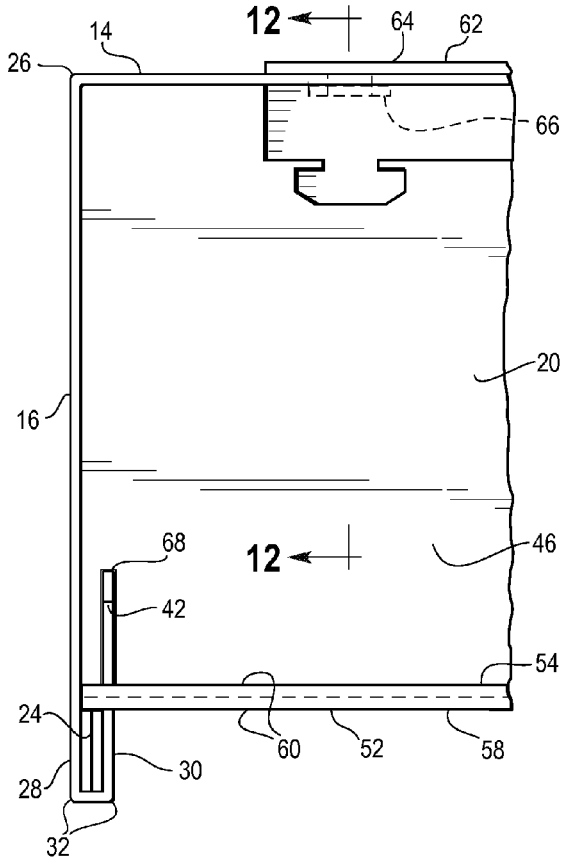
FIG. 11 is a cross-sectional view of the hutch of FIG. 1 taken along line 11-11.

FIG. 11 is a cross-sectional view of the hutch 10 of FIG. 1 taken along line 11-11. The locator tabs 42 extend through slots 68 located on the lateral sides of each shelf 20 when the shelves 20 are rotated into the "display" position.

Figure 12:
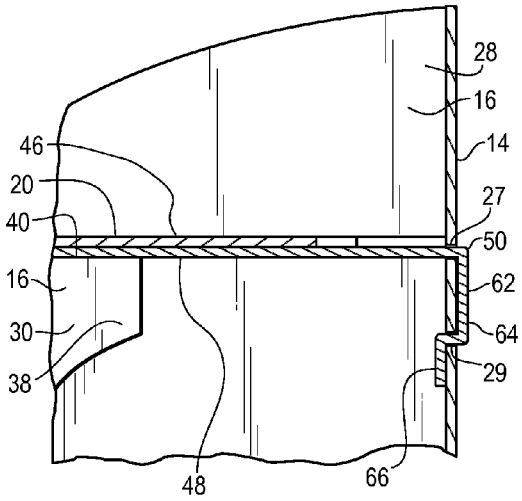
FIG. 12 is a cross-sectional view of the hutch of FIG. 11 taken along line 12-12.

FIG. 12 is a cross-sectional view of the hutch 10 of FIG. 11 taken along line 12-12 and showing the cut out portion 62 of a shelf 20 extending through the elongated slot 27 in the back wall 14 and folded downward along one of the rear double fold lines 50 in the shelf 20. The tabs 66 extending from the body 64 of the cutout portion 62 are inserted back through the narrow slots 29 in the back wall to foldably secure the shelf 20 to the back wall 14.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A hutch comprising:

a back wall made from a first blank and defining at least one elongated slot and having two vertical edges;

at least one shelf made from a second blank and comprising a bottom panel having two lateral sides and a cut out portion rotatably attached to the bottom panel about a rear fold line, the cut out portion being inserted through an elongated slot in the back wall, the bottom panel defining a slot on either lateral side of the bottom panel;

an outer panel made from the first blank and hingedly attached to each vertical edge of the back wall along a rear fold line, the outer panel having a rear edge adjoining the rear fold line and a front edge adjoining a vertically oriented double fold line;

an inner panel made from the first blank and hingedly connected to each outer panel along one of the vertically oriented double fold lines, each inner panel comprising at least one integrally formed first shelf support, each first shelf support having a top edge and a locator tab extending upward from the top edge and configured to extend through one of the lateral slots in the bottom panel.

2. The hutch of claim 1, wherein:

each lateral side of each shelf is supported by the top edge of a first shelf support.

3. The hutch of claim 1 further comprising:

two side wall supports made from two third blanks, each side wall support captured between the outer panel and the inner panel of each side wall, each side wall support comprising at least one integrally formed second shelf support, each second shelf support having a top edge, wherein each lateral side of each shelf is also supported by the top edge of a second shelf support.

4. The hutch of claim 3 wherein:

each side wall support comprises two hingedly connected, similarly shaped halves which are folded together to form a side wall support having a double thickness.

5. The hutch of claim 1 wherein each shelf further comprises:

a top panel rotatably attached to the bottom panel along double fold lines and having two lateral sides, the top and bottom panels being folded together so that the top panel lies flat against the bottom panel, the top panel defining a slot on either lateral side of the top panel, the top panel slots being in vertical alignment with the bottom panel slots; wherein the locator tab in each first shelf support further extends through one of the top panel slots.

6. The hutch of claim 1 wherein:

the back wall and the two side walls are formed from a first blank; and each shelf is formed from one of a number of second blanks.

7. The hutch of claim 3 wherein:

the back wall and the two side walls are formed from a first blank;

each shelf is formed from one of a number of second blanks; and each side wall support is formed from one of two third blanks.

8. The hutch of claim 7 wherein:

the blanks are made of corrugated board.

9. A hutch comprising:

a back wall and two side walls formed from a first blank, the back wall having two vertical edges and defining vertically spaced apart, horizontal, elongated slots, the two side walls being foldably attached to the vertical edges of the back wall along a rear fold line, each side wall comprising an outer panel and an inner panel connected by vertically oriented double fold lines that form two laterally spaced apart front edges of the hutch, the outer and inner panels being in spaced parallel relationship to each other, each inner panel comprising a plurality of vertically arranged shelf supports, each shelf support having a horizontally oriented top edge and a locator tab extending upward from the top edge; and a plurality of shelves, each shelf made from one of a plurality of second blanks, each shelf comprising a top panel attached to a bottom panel along double fold lines, the top panel comprising a cut out portion foldably connected to the bottom panel along the double fold line, the top panel and the bottom panel each defining slots located along laterally disposed sides, the top panel folded over onto the bottom panel so that the top panel lies flat against the bottom panel and the slots in the top panel align with the slots in the bottom panel, the cut out portion of each shelf being inserted into one of the elongated slots in the back wall so that the shelves are rotatably connected to the back wall portion.

10. The hutch of claim 9 wherein:

the two side walls are rotatable between a first flat position in which the two side walls are substantially co-planar with the back wall and a second display position in which the side walls are perpendicular to the back wall and the shelf supports of one side wall are laterally spaced from the shelf supports of the other side wall; and wherein each shelf is rotatable between a first flat position in which the shelf lies substantially flat against the back wall and a second display position in which the shelf extends perpendicularly outward from the back wall and abuts the top edges of laterally spaced shelf supports and the locator tabs of each pair of laterally spaced shelf supports extend through the slots in the shelf.

11. The hutch of claim 10 further comprising:

two side wall supports, each made from one of two third blanks, each side wall support captured between the outer panel and the inner panel of one of the side walls, each side wall support comprising a plurality of vertically arranged second shelf supports, each of the second shelf supports of one side wall support being laterally spaced from a second shelf support of the other side wall support, each second shelf support having a horizontally oriented top edge, wherein in the second display position each shelf also abuts the top edges of a pair of laterally spaced apart second shelf supports.

12. The hutch of claim 11 wherein:

each side wall support comprises two hingedly connected, similarly shaped halves which are folded together to form a side wall support having a double thickness.

13. The hutch of claim 11 wherein:

the first and second blanks are made of corrugated board.

14. The hutch of claim 11 wherein:

the first, second and third blanks are made of corrugated board.

15. A method of assembling a hutch comprising the steps of:

providing a first blank including a back wall portion defining vertically spaced apart, horizontal, elongated slots and two side wall portions foldably attached to the back wall portion, each side wall portion comprising an outer panel and an inner panel connected by vertically oriented double fold lines, each inner panel comprising a plurality of vertically arranged shelf supports, each shelf support having a top edge and a locator tab extending upward from the top edge;

providing a plurality of second blanks, each second blank comprising a top panel portion attached to a bottom panel portion along double fold lines, the top panel portion comprising a cut out portion foldably connected to the bottom panel portion along the double fold line, the second blank defining slots located in the top panel and in the bottom panel;

folding the top panel of each second blank along the double fold lines until the top panel lies flat against the bottom panel and the slots in the top and bottom panels align to form a plurality of shelves;

inwardly folding the side wall portions until they are substantially perpendicular to the back wall portion;

inwardly folding the side wall inner panels until they are substantially parallel to and spaced apart from the outer panels; and inserting the cut out portion of each shelf into one of the elongated slots in the back wall so that the shelves are rotatably connected to the back wall; and adjusting the position of each shelf so that the shelf extends perpendicularly outward from the back wall portion and abuts the top edges of the laterally spaced shelf supports and the locator tabs of the laterally spaced shelf supports extend through the slots in the shelf.

16. The method of claim 15 comprising the further steps of:

providing a pair of third blanks, each third blank comprising two halves foldably connected to form a side wall support having a double thickness of material;

placing a side wall support against an inner facing surface of each side wall outer panel.

* * * * *